US006213601B1

(12) United States Patent
Akuzawa et al.

(10) Patent No.: US 6,213,601 B1
(45) Date of Patent: Apr. 10, 2001

(54) INK-JET PRINTER AND METHOD OF CONTROLLING THE SAME

(75) Inventors: Yoshihide Akuzawa; Yasuhiro Suzuki; Hitoshi Ushiogi, all of Shizuoka-ken (JP)

(73) Assignee: Kabushiki Kaisha Tec, Tagata-gun (JP)

( * ) Notice: Subject to any disclaimer, the term of this patent is extended or adjusted under 35 U.S.C. 154(b) by 0 days.

(21) Appl. No.: 09/235,331

(22) Filed: Jan. 22, 1999

(30) Foreign Application Priority Data

Jan. 22, 1998 (JP) ..... 10-010858

(51) Int. Cl.[7] ..... B41J 2/18
(52) U.S. Cl. ..... 347/89
(58) Field of Search ..... 347/85, 86, 87, 347/89

(56) References Cited

U.S. PATENT DOCUMENTS

| | | | | |
|---|---|---|---|---|
| 4,432,003 | * | 2/1984 | Barbero et al. | 347/55 |
| 4,672,390 | * | 6/1987 | Ishikawa | 347/74 |
| 5,485,187 | * | 1/1996 | Okamura et al. | 347/85 |
| 5,621,446 | * | 4/1997 | Tanaka et al. | 347/85 |
| 5,956,062 | * | 9/1999 | Omata et al. | 347/89 |
| 6,019,460 | * | 9/1999 | Ushiogi et al. | 347/85 |
| 6,116,727 | * | 10/2000 | Hagiwara | 347/89 |
| 6,126,267 | * | 10/2000 | Ito et al. | 347/35 |

FOREIGN PATENT DOCUMENTS

| | | | |
|---|---|---|---|
| 803362 | * | 10/1997 | (EP) . |
| 0903240 A2 | | 3/1999 | (EP) . |
| 1562878 | | 3/1980 | (GB) . |
| 03169564 | | 7/1991 | (JP) . |

OTHER PUBLICATIONS

09/123,193, Ito et al., Jet Printer, All Pages, Jul. 1998.*
09/153,820, Ushiogi et al., Ink Jet Printer, All Pages, Sep. 1998.*
09/152,411, Ito et al., Ink Jet Printer with Ink Nozzle Purging Device, All Pages, Sep. 1998.*
09/153839, Ito et al., Ink Jet Printer, All Pages, Sep. 1998.*
Patent Abstracts of Japan, vol. 015, No. 491, Dec. 12, 1991.

* cited by examiner

*Primary Examiner*—N. Le
*Assistant Examiner*—Michael Nghiem
(74) *Attorney, Agent, or Firm*—Pillsbury Winthrop LLP

(57) ABSTRACT

An ink-jet printer, having a print head for jetting ink, an ink supply tube connecting between an ink tank and the print head, an ink supply pump interposing in the ink supply tube, an ink return tube connecting between and the print head and the ink tank, an ink return pump interposing in the ink return tube, a controller for controlling the ink supply pump and the ink return pump to fill the print head with ink in the ink tank, the volume of ink supplied by the ink return pump is greater than the volume of ink returned by the ink return pump in filling mode. Thus a foreign matter in the ink-jet nozzles of the print head can be cleaned by flowing out a foreign matter in the ink-jet nozzles.

12 Claims, 4 Drawing Sheets

INK-JET PRINTER AND METHOD OF CONTROLLING THE SAME

BACKGROUND OF THE INVENTION

The present invention relates to an ink-jet printer which prints an image onto a print medium held on a rotary drum with ink jetted from a print head, and particularly, to an ink-jet printer in which ink is supplied from an ink tank apart from the print head.

Hitherto, serial-type ink-jet printers are widely spreading. In the serial-type ink-jet printer, a print head and an ink tank of a relatively small capacity are mounted on a carriage, and the carriage is movably attached to a guide bar extending across a paper sheet to be printed. The paper sheet is fed in a direction perpendicular to the guide bar at a constant pitch, and the carriage is moved along the guide bar each time paper sheet is fed by the pitch. During the movement of the carriage, the print head jets ink droplets. In a serial-type color ink-jet printer, a plurality of print heads are employed and are supplied with ink of different colors from the respective ink tanks. The plurality of print heads are beforehand filled with ink when the printer is shipped. In the structure as described above, a color image of A4 size is printed out at a relatively low speed.

Thereto in recent years, a drum rotation type ink-jet printer capable of printing a color image at a high speed has been known. This ink-jet printer includes a rotary drum rotating in one direction and a print head disposed to face a paper sheet held on the rotary drum. The print head has a plurality of line-type nozzle units which are arranged along the peripheral surface of the rotary drum, corresponding to cyan(C), yellow(Y), magenta(M) and black(B). Each nozzle unit has a plurality of ink-jet nozzles disposed across the paper sheet in the axial direction of the rotary drum. This ink-jet printer jets ink droplets from nozzle units in response to image signals to print a color image on the paper sheet rotating together with the rotary drum. In this structure, a color image of A4 size can be printed extremely faster than the above-described serial-type printers.

In this drum-rotation type ink-jet printer, a plurality of ink tanks are placed apart from the print head and store ink of different colors to be supplied to the nozzle units of the print head. Each ink tank is connected to a corresponding nozzle unit via a supply tube, and is filled with ink supplied from an ink supplement bottle detachably attached thereto. The ink is conveyed from the ink tank to an ink pressure chamber of the nozzle unit by a supply pump having a valve function and interposed in the supply tube. At the time of printing, the supply pump is stopped in a valve-open state, and the nozzle unit is driven to jet ink. Upon consumption of ink for jet, ink is supplemented to the ink pressure chamber through the supply tube by a capillary action.

In the above-described drum rotation type ink-jet printer, the nozzle unit is empty when the printer is shipped and is filled with ink at a user side when the printer is used. A foreign matter such as a lump of dried ink may exist in the nozzle unit at the beginning of ink-supply. Thus, ink-jet nozzles of the nozzle unit is apt to be clogged by the foreign matter and the quality of printing carried out by such a nozzle unit is deteriorated.

BRIEF SUMMARY OF THE INVENTION

An object of the present invention is to carry out a high quality printing on a print medium by ink jet printer.

Still another object of the present invention is to prevent a lump of dried ink from entering into a plurality of ink-jet nozzles of an ink-jet printer.

Another object of the present invention is to provide an ink-jet printer which can has a unique ink supply system.

According to the present invention, there is provided an ink-jet printer which comprises: a print head for jetting ink, the print head having an upstream side and a downstream side; an ink tank for storing the ink; a tube member connected between the ink tank and the print head; a pump mechanism including a plurality of pumps located at the upstream side and the downstream side of the print head, respectively, the pump mechanism being in fluid. communication with the print head and the ink tank through the tube member; and a controller for controlling the pump mechanism in a filling mode in which the print head is filled with ink flowing from the ink tank.

DETAILED DESCRIPTION OF THE PREFERRED EMBODIMENT

An ink-jet printer according to an embodiment of the present invention is described with reference to FIGS. 1 to 6.

Figure 1:
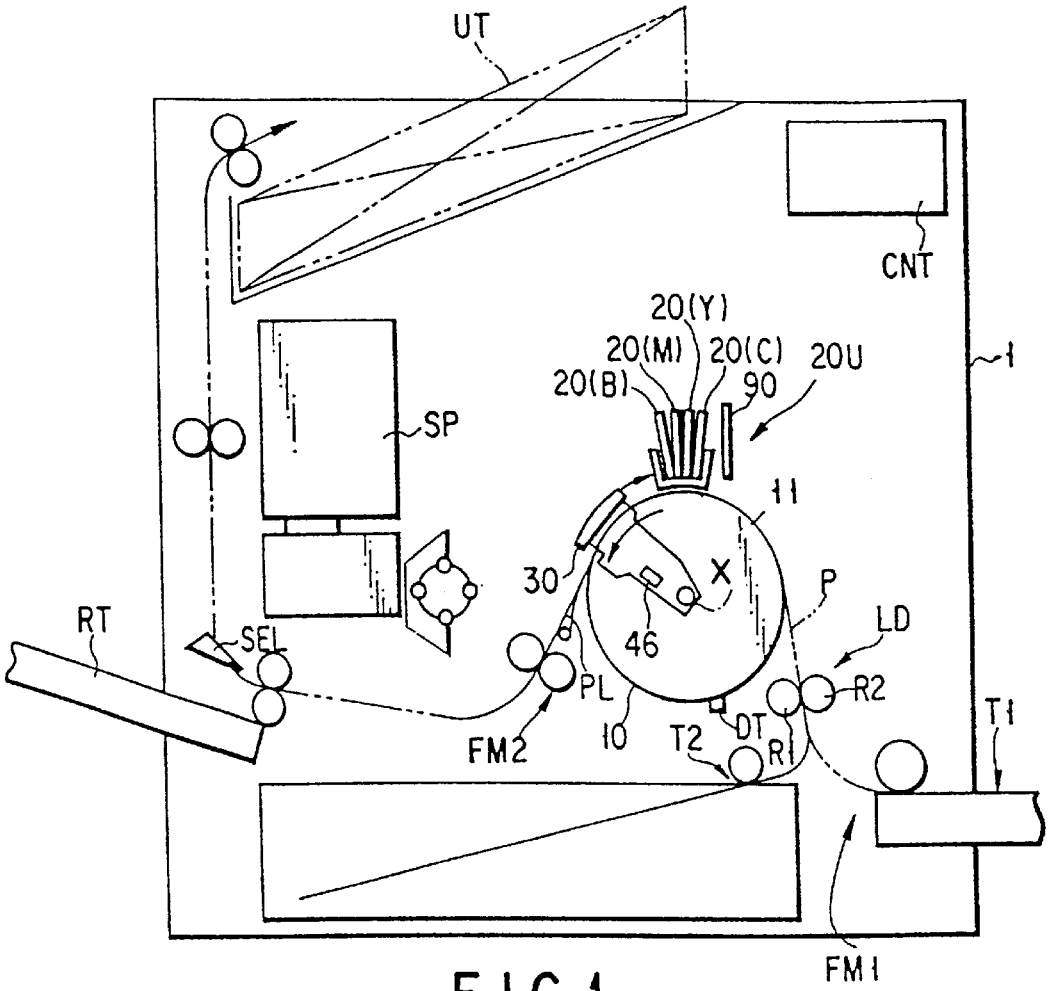
FIG. 1 is a view showing the internal structure of an ink-jet printer according to an embodiment of the present invention.

FIG. 1 shows the internal structure of the ink-jet printer. The ink-jet printer is used to perform a multicolor printing on a paper sheet P cut as a printing medium. The paper sheet P may be a plain paper, a coated paper or an OHP sheet.

The ink-jet printer comprises a rotary drum 10, a print head 20U, a manual-feed tray T1, a paper cassette T2, a sheet feed-in mechanism FM1, a sheet feed-out mechanism FM2, an ink supply system SP and a control unit CNT. The rotary drum 10 rotates at a predetermined circumferential speed, with a paper sheet P held thereon. The print head 20U performs a multicolor printing on the paper sheet P. The manual-feed tray T1 places thereon paper sheets P for feeding one by one. The paper cassette T2 stores therein a stack of paper sheets P. The sheet feed-in mechanism FM1 feeds each paper sheet P from the paper cassette T2 or the manual-feed tray T1 onto the rotary drum 10. The sheet feed-out mechanism FM2 feeds out the paper sheet P printed at the rotary drum 10. The ink supply system SP performs an ink supply. The control unit CNT controls the overall operation made by the components or circuits of the ink jet printer. The control unit is construed as a controller.

As shown in FIG. 1, the rotary drum 10 is located near the central position within a housing 1. The manual-feed tray T1 is located below the rotary drum 10 and extends externally from a side wall face of the housing 1, and the paper cassette T2 is located under the rotary drum 10. The sheet feed-in mechanism FM1 is placed upstream of the rotary drum 10. The print head 20U is located above the rotary drum 10. The sheet feed-out mechanism FM2 is located downstream of the rotary drum 10.

Figure 2:
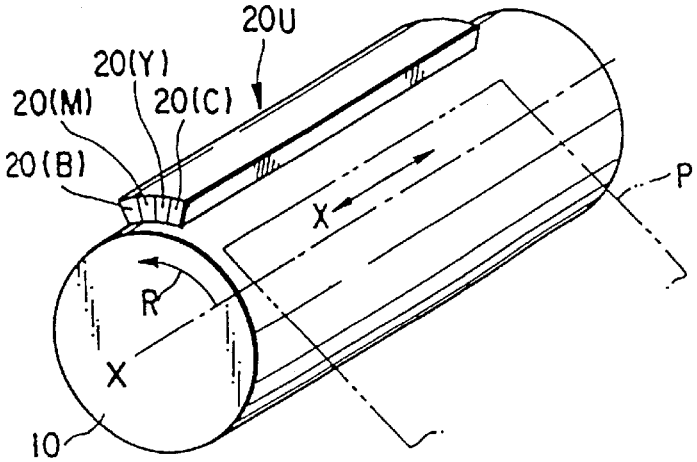
FIG. 2 is a perspective view showing a positional relationship between the rotary drum and the print head shown in FIG. 1.

The rotary drum 10 is supported about the axis X, and causes the paper sheet P to be wound around a peripheral surface 11 thereof in accordance with its rotation indicated by an arrow R in FIG. 2. The rotational position of the rotary drum 10 is detected by a rotational position detector DT disposed near the peripheral surface 11 of the rotary drum 10. The print head 20U includes four nozzle units 20 (C, Y, M, and B) which are arranged in order along the peripheral surface 11 of the rotary drum 10 from the upstream side to the downstream side so as to perform a printing on the paper sheet P with inks of cyan(C), yellow(Y), magenta(M), and black(B). The nozzle units 20 (C, Y, M, and B) receive ink of corresponding colors from the ink supply system SP. Each of the nozzle units 20 (C, Y, M, and B) has a plurality of ink-jet nozzles 23 which are arranged in the axial direction X of the rotary drum 10 to have a span corresponding to the width of the paper sheet P of A4 size and jet the corresponding color ink to the paper sheet P. The plurality of ink-jet nozzles 23 are provided with heaters acting as an energy generator and thus, ink is jetted from nozzles 23 when heaters are selectively energized in a print mode. Piezoelectric element may be used, instead of the heater, to jet ink.

Figure 3:
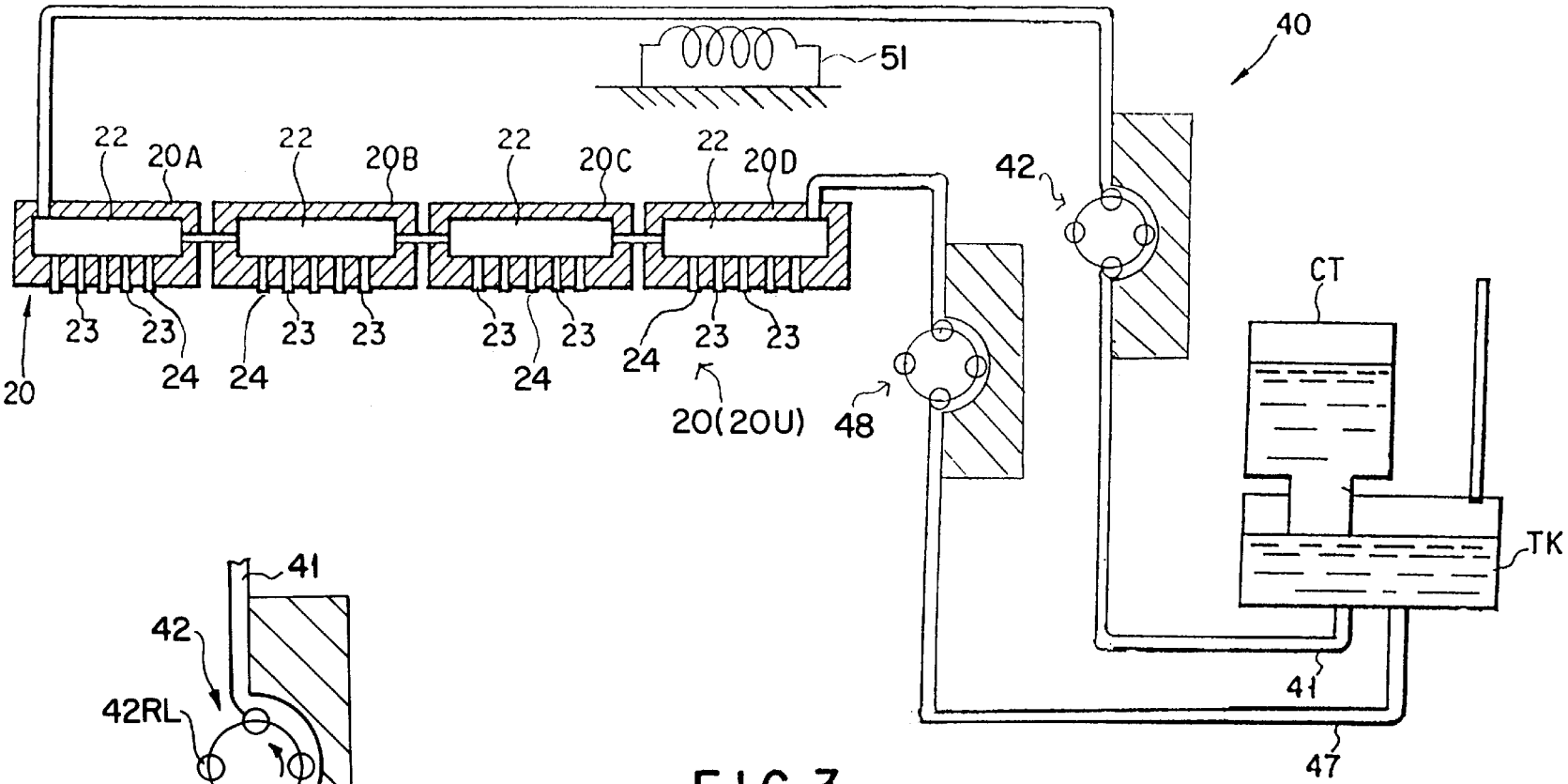
FIG. 3 is a schematic view showing an ink supply system of the ink-jet printer shown in FIG. 1.

The nozzle units 20 (C, Y, M, and B) are constructed in structures identical to each other. The nozzle segments 20A and 20C are mounted on a first surface of the connection plate, and the nozzle segments 20B and 20D are mounted on a second surface of the connection plate opposed to the first surface, for example. As shown in FIG.3, each of the nozzle segments 20A to 20D is constituted by ink-jet nozzles 23 and an ink pressure chamber 22 for directly applying ink to the ink-jet nozzles 23. The ink pressure chambers 22 of the nozzle segments 20A to 20D are connected in series such that ink flows there-through as shown in FIG. 3. Each of the ink pressure chambers 22 has a capacity of 0.55 ml. The pitch of the ink-jet nozzles 23 is set up to 1/150 inch, for example, in the case where the printing resolution is 300 dpi in the main scanning direction X.

The sheet feed-in mechanism FM1 has a sheet loader LD for loading the paper sheet P to the rotary drum 10 such that the width direction of the paper sheet P corresponds with the axial direction X of the rotary drum 10. The paper sheet P is taken out of either the manual feed tray T1 or the paper cassette T2 by the sheet feed-in mechanism FM1. The paper loader LD is controlled to load the paper sheet P toward the rotary drum 10 when the position detector DT detects the rotary drum 10 at a predetermined rotating position. The paper sheet P is then wound around the peripheral surfacell of the rotary drum 10 when the rotary drum 10 has made one rotation. The print head 20U prints a color image on the paper sheet P as the rotary drum 10 rotates.

The paper loader LD includes at least a pair of loading rollers Rl and R2 extending in the axial direction X of the rotary drum 10 to load the paper sheet P fed from the manual-feed tray T1 or paper cassette T2 to the rotary drum 10 at a predetermined timing. The feeding speed of the paper of the paper sheet P is set at a speed corresponding to the circumferential speed of the rotary drum 10. The peripheral surface 11 of the rotary drum 10 is about 220 mm wide in the axial direction X and 408 mm long in the rotational direction R. Therefore, the rotary drum 10 can fully hold the A4 size paper sheet P having a width of 210 mm and a length of 297 mm.

After the print is completed, the paper sheet P is removed from the peripheral surface 11 of the rotary drum 10 by a sheet separator PL and fed in a predetermined direction by the sheet feed-out mechanism FM2. Driving of the sheet feed-in mechanism FM1 and the sheet feed-out mechanism FM2 are performed by a sheet feed motor FM. The paper separator PL includes a separation claw to be contacted with the peripheral surface 11 of the rotary drum 10 at the time of sheet removal. A discharge switch SEL guides the paper sheet P to either a rear discharge tray RT or an upper discharge tray UT. The rear discharge tray RT receives the paper sheet P with the print surface facing upward, and the upper discharge tray UT receives the paper sheet P with the print surface facing downward.

The print head 20U is capable of being reciprocally shifted by 1/75 inch in the main scanning direction parallel to the axial direction X of the rotary drum 10. The rotary drum 10 holds the paper sheet P, and rotates in a sub-scanning direction perpendicular to the main scanning direction X. The rotary drum 10 is maintained at a constant rotation rate of 120 rpm and makes one rotation every 0.5 second, for example. In the printing operation, the print head 20U is shifted in the main scanning direction X at a constant rate of ½ nozzle pitch each time the rotary drum 10 makes one rotation, so that it move for a distance equal to a nozzle pitch PT while the rotary drum 10 makes two rotations.

As shown in FIG. 1, the ink-jet printer further includes an elevation mechanism 90 for automatically adjusting the height of the print head 20U, an ink collection tray 30 for collecting ink flowed out of the print head 20U during a non-printing time, and a reciprocating rotation mechanism 46 for rotating reciprocally the ink collection tray 30 along the peripheral surface 11 of the rotary drum 10 such that the ink collection tray 30 can face the print head 20U. At the time of printing, the elevation mechanism 90 moves the print head 20U to a lower limit position (print position) near the peripheral surface 11 of the rotary drum 10. After the print is completed. the elevation mechanism 90 moves the print head 20U to an upper limit position spaced from the rotary drum 10, and then to a non-print position wherein print head 20U is located between the upper and lower limit positions. The elevation mechanism 90 sets the print head 20U in a state where the print head 20U is disposed at the upper limit position at the non-printing time, so that the ink collection tray 30 is inserted between the print head 20U and the rotary drum 10. The print head 20U is further moved to the non-print position after insertion of the ink collection tray 30. In this state, a top end 24 of the ink-jet nozzle 23 of the nozzle unit 20 (C, Y, M, and B) is disposed close to the ink collection tray 30 without making contact with the tray 30, so that the ink collection try 30 can be used in common to collect inks flowed out of each the nozzle units 20 (C, Y, M, and B). Collected ink is drained as waste ink to a detachable waste ink cassette (not shown) from the ink collection tray 30.

As shown in FIG. 3 the ink supply system SP includes ink supply sections 40 for nozzle units 20 (C, Y, M, and B), respectively. Since the ink supply sections 40 for the nozzle units 20 have the same construction with one another, only one of the ink supply sections 40 will be described.

The ink supply section 40 includes an ink tank TK which is located apart from the nozzle unit 20 and stores ink, an ink reserve bottle CT for supplying ink to the ink tank TK, an ink supply tube 41 for guiding ink from the ink tank TK to an upstream side of the nozzle unit 20, and an ink return tube 47 for guiding ink from a downstream side of the nozzle unit 20 to the ink tank TK. The ink supply section 40 further includes a push type ink supply pump 42 interposed in the ink supply tube 41 and a pull type ink return pump 48 interposed in the ink return tube 47. The ink supply pump 42 performs an ink supply operation in which ink is forcibly pushed from the ink tank TK to the nozzle unit 20 through the ink supply tube 41 at a rate of 0.7 ml/sec. The ink return pump 48 performs an ink suction operation in which an excessive ink is forcibly pulled from the nozzle unit 20 to the ink tank TK through the ink return tube 47 at a rate of 0.35 ml/sec. The ink suction operation is construed as an ink return operation. The ink supply tube 41 and the ink return tube 47 are made of a soft synthetic resin.

Figure 4:
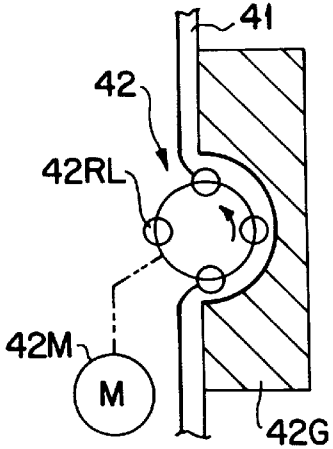
FIG. 4 is a view showing one example of an ink supply pump of the ink supply system shown in FIG. 3.

As shown in FIG. 4, the ink supply pump 42 is a conventional rotary type in which four press rollers 42RL are located at a predetermined interval on a circular locus. The ink supply tube 41 is located between the press rollers 42RL and the ink supply pump guide 42G which is formed in a semi-circular shape. The press rollers 42RL press the ink supply tube 41 against the ink supply pump guide 42G to act as a valve. The ink supply tube 41 is repeatedly set at a selected one of open and closed state as the press rollers 42RL are rotated by an ink supply pump motor 42M. Thus ink in the ink supply tube 41 pressed by adjacent press rollers 42RL is conveyed from an upstream side to a downstream side of the ink supply pump 42. Since construction and operation of the ink return pump 48 is the same as those of ink supply pump 42 and therefore, the explanation of these are omitted. As described above, when both pump motors are driven, ink is supplied between the ink tank TK and the nozzle unit 20, and is circulated. The ink supply tube 41 and the ink return tube 47 are construed as a tube member, the ink supply pump 42 and the ink return pump 48 are construed as a pump mechanism.

Further, as shown in FIG.3 a heating unit is located downstream of the ink supply pump 42 in the ink supply tube 41. The heating unit includes a heater 51 for heating ink supplying to nozzle unit 20 and an ink temperature detector 55. The ink temperature detector 55 detects temperature of ink heated by the heater 51.

Figure 5:
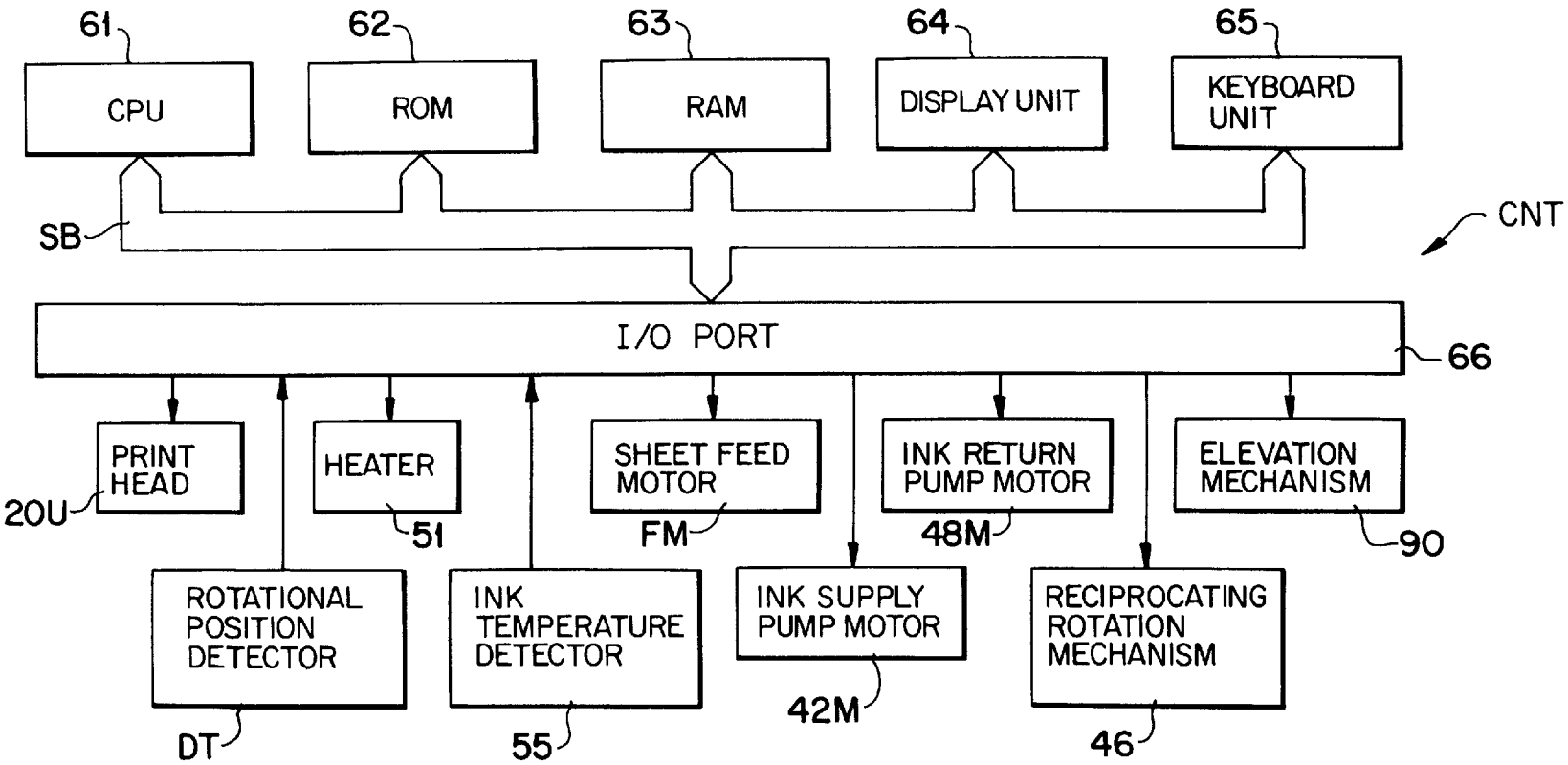
FIG. 5 is a block diagram illustrating a detailed control unit shown in FIG. 1.

As show in FIG. 5, the control unit CNT includes a CPU (Central Processing Unit) 61 for performing a processing control, a ROM (Read Only Memory) 62 for storing a control program for the CPU 61, a RAM (Random Access Memory) 63 for temporarily storing data items input into and output from the CPU 61, a display unit 64 for displaying the status of the ink-jet printer, a keyboard unit 65 for entering various mode (print mode, filling mode ) settings, and an input and output port (or I/O port) 66 serving as an interface for external components of the control unit CNT. The CPU 61 is connected to the ROM 62, the RAM 63, the display unit 64, the keyboard unit 65, and the I/O port 66 through a system bus SB. The I/O port 66 is connected to the print head 20U, the rotational position detector DT, the ink temperature detector 55, the heater 51, the ink supply pump motor 42M, the ink return pump motor 48M, the elevation mechanism 90, the reciprocating rotation mechanism 46 and the sheet feed motor FM.

The keyboard unit 65 is capable of setting a filling mode in which the nozzle unit 20 is filled with ink in the ink tank TK at the non-printing time. The ROM 62 stores a control program for starting the ink return pump motor 48M a preset time, for example, 30 seconds, after the ink supply pump motor 42M starts. It was experimentally confirmed beforehand that it took 30 seconds to fill ink into all of the ink-jet nozzles 23. The ROM 62 stores numbers of rotation per minute of the ink supply pump motor 42M and the ink return pump motor 48M. Further the ROM 62 stores the control program for controlling a voltage supplied to the heater 51 and optimum temperature volumes of color inks heated by the heater 51. Stored optimum temperature volumes are different from one another in terms of different color inks. The control unit CNT controls the heater 51 at a most pertinent temperature the range of which is 45° C. to 55° C. and therefore, nozzle unit 20 can be smoothly filled with ink by the supply system SP.

Figure 6:
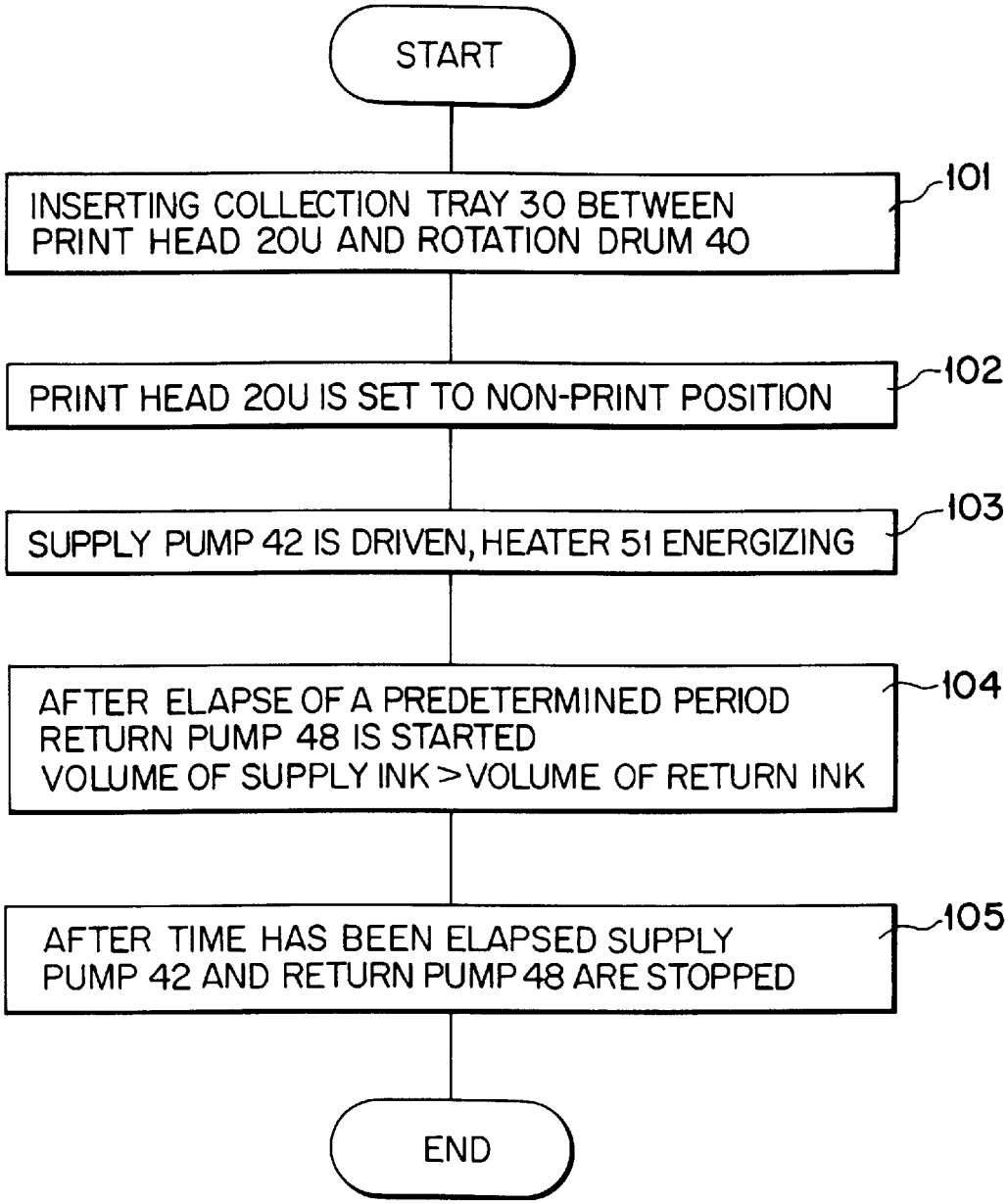
FIG. 6 is a flow chart showing an ink filling mode controlled by the control unit shown in FIG. 5.

A filling mode operation of ink-jet printer is described in more detail with reference to FIG. 6.

When the filling mode is requested through the keyboard unit 65, the control unit CNT controls the reciprocating rotation mechanism 46 to insert the ink collection tray 30 between the print head 20U and the rotation drum 10 as in step 101. The print head 20U is moved to the non-print position after insertion of the ink collection tray 30 in step 102. Under this state, control unit CNT performs a pump drive process described below. The control unit CNT controls the flow of ink from the print head 20U. In each ink supply section 40, the ink supply pump motor 42M and the ink return pump motor 48M are controlled as described below by the control unit CNT. The ink supply pump motor 42M is driven to supply ink from the ink tank TK to the nozzle unit 20 and the heater 51 is energized to heat ink at a most pertinent temperature of each color of inks in step 103. All of the presser chamber 22 is filled with ink from the tank TK by the supply pump 42 and ink reaches each ink-jet nozzles 23. 30 seconds after the ink supply pump motor 42M is driven, as described before. Then, the ink return pump motor 48M is driven. In other words, the ink return pump motor 48M and the ink supply pump motor 42M are not driven, simultaneously. At this time, the volume of ink supplied by the ink supply pump 42 is greater than that returned by the ink return pump 48 to increase the pressure of the ink pressure chamber 22 in step 104. Thus ink in the nozzle unit 20 flows out of nozzle unit 20 through the ink-jet nozzles 23 by the difference in the ink volume between ink supply pump 42 and the ink return pump 48. Therefore, a lump of dried ink and gas or air in the ink-jet nozzles 23 are discharged therefrom together with flowing ink and, in addition, gas or air outside the ink-jet nozzles 23 can be prevented from entering into the ink-jet nozzles 23. After an elapse of a predetermined time, the ink supply pump motor 42M and the ink return pump motor 48M are stopped in step 105. Namely, the ink supply tube 41, the nozzle unit 20 and the ink return tube 47 are filled with ink. Ink flowing out of nozzle unit 20 is collected by the ink collection tray 30, and is drained to the waste ink cassette as a waste ink.

In the ink-jet printer according to the present embodiment, the control unit CNT performs the pump drive process in the filling mode, so that a foreign matter in the ink-jet nozzles 23 of the print head 20U can be discharged by the ink flowing out of the ink-jet nozzles 23. Further the difference in ink flow rate between the ink supply pump 42 and the ink return pump 48 prevent gas or air outside the ink-jet nozzles 23 from entering into the ink-jet nozzles 23 in the pump drive process.

Furthermore, in the ink filling mode, the ink supply pump motor 42M is driven prior to the operation of ink return pump motor 48M, and the ink return pump motor 48M is driven after ink in the ink-jet nozzles 23 has flowed. Thus, it can prevent a foreign matter which may float around the end surface 24 of the ink-jet nozzles 23 from entering into the ink-jet nozzles 23.

Therefore, an ink-jet printer of the present embodiment can print images on a paper sheet with high quality and smoothness.

Moreover the ink-jet printer can fill the ink nozzle unit 20 with ink smoothly by heating ink flowing through the ink supply tube 41.

The present invention has been described with respect to a specific embodiment. However, other embodiments based on the principles of the present invention should be obvious to those of ordinary skill in the art. Such embodiments are intended to be covered by the claims.

What is claimed is:

1. An ink-jet printer, comprising:

a print head for jetting ink, the print head having an upstream side and a downstream side;

an ink tank for storing the ink;

an ink supply tube connected between the ink tank and the upstream side of the print head;

an ink supply pump interposed in the ink supply tube for forcibly supplying ink from the ink tank to the print head through the ink supply tube;

an ink return tube connected between the downstream side of the print head and the ink tank;

an ink return pump interposed in the ink return tube for forcibly returning ink from the print head to the ink tank through the ink return tube; and a controller for controlling the ink supply pump and the ink return pump to fill the print head with ink in the ink tank when the print head is in a non-print position, a volume of ink supplied by the ink supply pump being greater than a volume of ink returned by the ink return pump in a filling mode.

2. An ink-jet printer according to claim 1, wherein the ink tank includes a cyan color ink tank, a yellow color ink tank and a magenta color ink tank.

3. An ink-jet printer according to claim 1, further including a heater located between the ink supply pump and the print head for heating ink in the ink supply tube.

4. An ink-jet printer according to claim 1, wherein the heater is energized for the period of driving of the ink supply pump.

5. An ink-jet printer according to claim 1, wherein the print head includes an ink pressure chamber and the ink return pump is driven after the ink pressure chamber is filled with ink by supply pump.

6. An ink-jet printer according to claim 1, wherein the ink supply pump and the ink return pump are rotary type pump which has a plurality of pressure rollers, each of the rollers pressing the ink supply tube and the ink return tube.

7. An ink-jet printer according to claim 6, wherein the ink supply tube and the ink return tube is made of a synthetic resin.

8. An ink-jet printer according to claim 1, wherein ink flows out of the print head when the control operation by the controller is effected, and the printer further includes an ink collection tray to collect the ink from the print head.

9. A method for controlling an ink-jet printer comprising a print head for jetting ink, the print head having an upstream side and a downstream side, an ink tank for storing the ink, an ink supply tube connecting between the ink tank and the upstream side of the print head, an ink supply pump interposed in the ink supply tube for forcibly supplying ink from the ink tank to the print head through the ink supply tube, an ink return tube connecting between the downstream side of the print head and the ink tank, an ink return pump interposed in the ink return tube for forcibly returning ink from the print head to the ink tank through the ink return tube, the method comprising the steps of:

driving the ink supply pump and the ink return pump to fill the print head with ink stored in the ink tank when the print head is in a non-print position, such that a volume of ink supplied by the ink supply pump is greater than that returned by the ink return pump in a filling mode; and controlling the print head and the ink supply pump to print an image on a medium by jetting ink from the print head in a print mode.

10. A method according to claim 5, wherein the driving step includes a sub step driving the ink return pump a predetermined time after the driving of the ink supply pump.

11. A method for performing a filling mode by an ink-jet printer comprising a print head having a plurality of nozzles, an ink tank, an ink supply pump connected between an upstream side of the print head and the ink tank and an ink return pump connected between a downstream side of the print head and the ink tank, the method including the steps of:

driving the ink supply pump to supply ink from the ink tank to the print head;

filling the print head with ink;

discharging the ink from the plurality of nozzles of the print head;

driving the ink return pump to return the discharged ink from the print head to the ink tank; and controlling a volume of ink supplied by the ink supply pump and a volume of ink returned by the ink return pump so that the volume of ink supplied by the ink supply pump to the print head when the print head is in a non-print position is greater than that returned by the ink return pump.

12. A method according to claim 11, wherein the ink-jet printer has a heater, the method including a step of heating ink supplied by the ink supply pump with said heater.

* * * * *